US005251676A

United States Patent [19]

Yeh

[11] Patent Number: 5,251,676

[45] Date of Patent: Oct. 12, 1993

[54] CLEANING TISSUE WITH A RAYON CUT PILE

[75] Inventor: Joe Yeh, Chiao, Taiwan

[73] Assignee: Antoinette LeFrancois, C.P., Beloeil, Canada

[21] Appl. No.: 741,726

[22] Filed: Aug. 7, 1991

[51] Int. Cl.[5] ..... D03D 27/02

[52] U.S. Cl. ..... 139/402; 26/2 R; 26/8 R; 28/159; 139/391; 139/420 R

[58] Field of Search ..... 26/2 R, 3, 8 R, 8 C, 26/9, 10 R, 10 C; 28/159, 160, 162; 139/396, 391, 402, 404, 420 R, 39

[56] References Cited

U.S. PATENT DOCUMENTS

| | | | |
|---|---|---|---|
| 2,950,741 | 8/1960 | Janney et al. | 139/39 |
| 3,721,273 | 3/1973 | Sherrill et al. | 139/396 |
| 3,721,274 | 3/1973 | Sherrill et al. | 139/396 |
| 3,922,404 | 11/1975 | Priester, Jr. | 26/2 R |

*Primary Examiner*—Andrew M. Falik
*Attorney, Agent, or Firm*—Samuel Meerkreebs

[57] ABSTRACT

A textile material which consists of interweaving of synthetic filaments as warps and wefts having a fluffy layer of a pile of rayon fixed to the textile material by having its base curved around warps and wefts and wherein the pile is shaved to constitute a uniform surface wherein the material is useful for general cleaning when used with or without a cleaning product.

1 Claim, 1 Drawing Sheet

FIG. 1
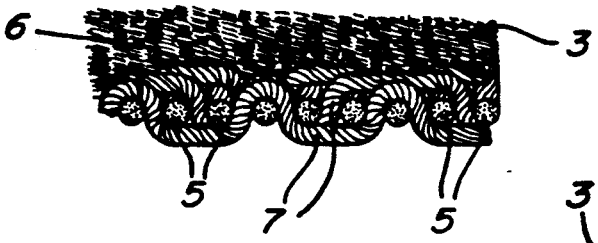
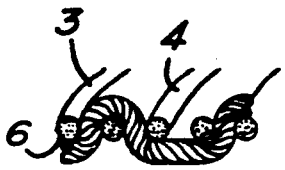
FIG. 3
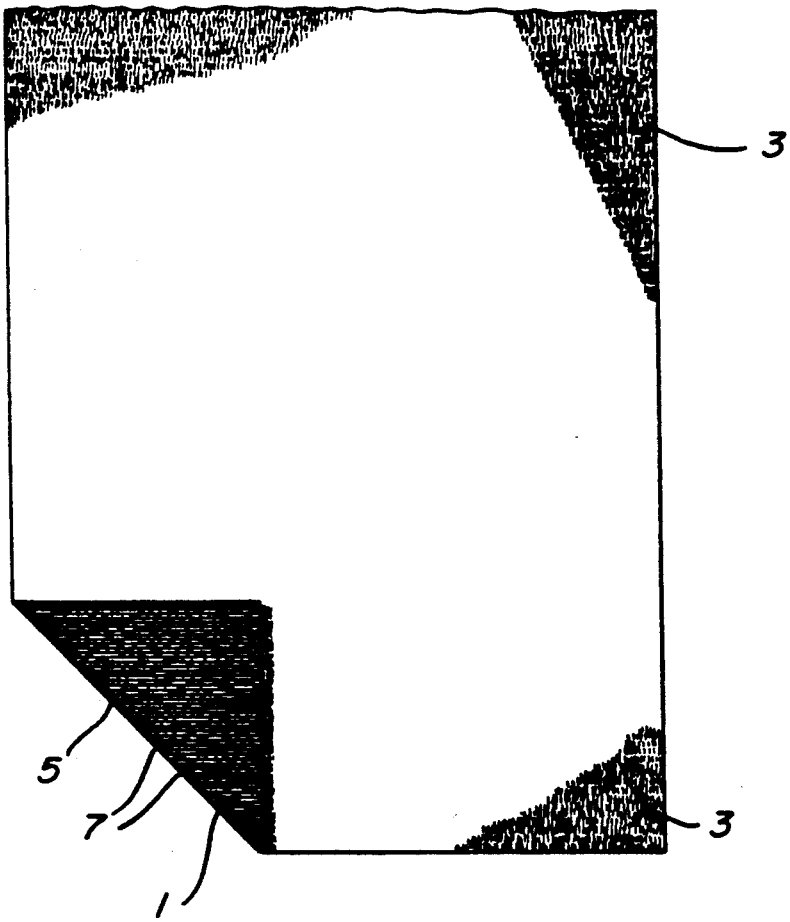
FIG. 2

CLEANING TISSUE WITH A RAYON CUT PILE

BACKGROUND OF THE INVENTION (a) Field of the Invention

The present invention concerns a cleaning and/or products applying tissue. More specifically, the invention in concerned with a tissue which is very easy to clean after use, contrary to the products which are found on the market or which are used in normal manner.

(b) Description of Prior Art

For various daily cleaning tasks and for applying products, all kinds of articles are used, among them old rags, papers of various nature, J Cloth or other products of the same type. Whenever the products are used, it has always been found that these articles do not give complete satisfaction, or are not resistant enough, which is mainly the case for paper base products. There is therefore a need to produce a new product which would be highly resistant and which fulfill well its functions.

SUMMARY OF INVENTION

For this purpose, there is provided a cleaning and/or product applying tissue comprising a textile material consisting of an interweaving of synthetic filaments, as well as a fluffy layer of rayon pile fixed to the textile material.

Preferably, the filaments are made of polyester and are interweaved into a network of warps and wefts, the base of the pile being curved around the warp and/or weft of the textile material, and the pile being shaved so as to constitute a uniform surface.

The length of the pile is usually set at a value which is about 0.2 to 1.0 centimeter, and preferably the pile is slanted on the textile material by being uniformly oriented.

BRIEF DESCRIPTION OF DRAWINGS

The invention will now be illustrated without limitation by means of the annexed drawings, in which FIG. 1 is an enlargement in cross-section showing the pile on the textile material;

FIG. 2 is a plan view with a corner being folded showing the pile as well as the reversed side of the textile material; and FIG. 3 is a view showing the attachment of the pile to the textile material.

DESCRIPTION OF PREFERRED EMBODIMENTS

With reference to the drawings, it will be seen that the tissue in question consists of a textile material 1 on which a fluffy layer of rayon pile 3 is fixed by having its base 4 attached thereto. On the other hand, it will be seen that the textile material is made of an interweaving of warps and wefts 5 and 7 respectively of known synthetic filament, such as polyester.

The pile is made in a well known manner in the art from very thin filaments of rayon wound at its base around one wrap and two wefts latter are held by the textile material by having their base curved at 6 around a warp 5 or a weft 7 as seen in FIG. 3. It is on the other hand essential that the pile be uniformly slanted;

For better results, the pile will be shaved between 0.2 and 1 centimeter long, it being understood that the fluffy layer should be uniform.

It has been observed that this tissue has a high capacity for absorbing materials so that foreign substances which one wishes to get rid of are caught on the textile material at the base of the pile. A simple water rinse is thereafter sufficient to clean the tissue which can then be reused. It would appear that the rayon which constitutes the pile gives to this tissue its cleaning power while the synthetic nature of the textile material makes it extremely easy to rinse.

This article can for example be used for cleaning furnitures, kitchen utensils, walls, floors and ceilings, oil stains, cars, glasses, mirrors and others. It can also be used for body care, for example washing, applying products, etc. In other words, it has been found that this product is extremely useful to catch foreign materials such as dirt and to release the same by a mere washing with water.

The product is highly resistant and last a long time after many uses.

I claim:

1. Tissue for cleaning or applying product comprising a textile material consisting of interwoven synthetic filaments defining warps and wefts, and a fluffy layer of a pile of rayon fixed to said textile material, said pile having a base which is curved around said warps and wefts of said textile material and being shaved to define a uniform surface, the length of said pile being between 0.2 and 1.0 centimeter, the textile material comprising a polyester filament.

* * * * *